US010124931B2

(12) United States Patent
Koch

(10) Patent No.: US 10,124,931 B2
(45) Date of Patent: Nov. 13, 2018

(54) CONTAMINATION-FREE, FLEXIBLE CLOSURE SYSTEM FOR USE ON AT LEAST PARTIALLY FLEXIBLE CONTAINERS

(71) Applicant: Flecotec AG, Muellheim (DE)

(72) Inventor: Martin Koch, Neuenburg (DE)

(73) Assignee: FLECOTEC AG, Muellheim (DE)

( * ) Notice: Subject to any disclaimer, the term of this patent is extended or adjusted under 35 U.S.C. 154(b) by 246 days.

(21) Appl. No.: 14/648,753

(22) PCT Filed: Jan. 2, 2014

(86) PCT No.: PCT/EP2014/050013
§ 371 (c)(1),
(2) Date: Jun. 1, 2015

(87) PCT Pub. No.: WO2014/106632
PCT Pub. Date: Jul. 10, 2014

(65) Prior Publication Data

US 2015/0314922 A1 Nov. 5, 2015

(30) Foreign Application Priority Data

Jan. 2, 2013 (DE) ..... 10 2013 000 011

(51) Int. Cl.
*B65D 33/16* (2006.01)
*B65D 33/00* (2006.01)
*B65D 33/25* (2006.01)

(52) U.S. Cl.
CPC ..... *B65D 33/00* (2013.01); *B65D 33/2541* (2013.01); *B65D 33/2566* (2013.01); *Y10T 24/158* (2015.01)

(58) Field of Classification Search
CPC .... B65D 33/2591; B65D 81/32; B65D 33/16; B65D 33/2541; B65D 21/02; B65D 33/24;
(Continued)

(56) References Cited

U.S. PATENT DOCUMENTS 3,627,600 A 12/1971 Reiter
4,268,938 A 5/1981 Walchli
(Continued)

FOREIGN PATENT DOCUMENTS

DE 10 2004 003 511 B4 8/2005
DE 10 2009 018 565 B3 11/2010
(Continued)

*Primary Examiner* — Jack W Lavinder
(74) *Attorney, Agent, or Firm* — Wenderoth, Lind & Ponack, L.L.P.

(57) ABSTRACT

A closure (10, 20) has two profiled strips (11, 12; 21, 22) for an at least panially flexible container (1, 2) for connecting a first container (1) to a second container (2) in an environmentally sealed manner and in a closed docking position, and for conducting a flow in a flow direction (D) through the closure (10, 20) from the first container (1) into the second container (2) in an environmentally sealed manner and in an open docking position. The second container (2) has an identical closure (10, 20) facing the first container (1), and, in the open docking position, is in engagement with the closure (10, 20) of the first container (1). Together with the closure (10, 20) of the first container (1), a flow channel (3) is defined for the through flow in the flow direction (D). The closures (10, 20) can be docked to each other and opened jointly in a single step by a separate slider. Due to the dual functional nature of all the closure elements, no closure element (13, 14; 23, 24) is exposed in the channel-upward direction to the material to be transferred. A slider (30) connects and separates the closures (10, 20), and has an insenion side (31), on which the closures (10, 20) can be insened into the slider (30) in insertion directions (A, B), which form an acute angle, and an output side (32) opposite the insenion side (31), on which the closures (10, 20), which are connected to each other and are open, can be led out from the slider (30) in a common slide direction (C).

14 Claims, 4 Drawing Sheets

(58) Field of Classification Search
CPC ..... B65D 33/246; B65D 81/3261; B65G 69/183; Y10S 493/927; B65B 1/28; B65B 51/046; B65B 69/00; Y10T 24/2513; Y10T 24/2545; A45C 13/1023
USPC ..... 53/468, 469, 480, 481
See application file for complete search history.

(56) References Cited

U.S. PATENT DOCUMENTS

| | | | | |
|---|---|---|---|---|
| 7,770,936 | B2 * | 8/2010 | Koch | B65B 1/28 141/10 |
| 2004/0151405 | A1 | 8/2004 | Shaffer | |
| 2012/0090279 | A1 | 4/2012 | Untch | |

FOREIGN PATENT DOCUMENTS

| | | | |
|---|---|---|---|
| EP | 1 083 137 | A1 | 3/2001 |
| EP | 1 441 953 | B1 | 12/2005 |
| EP | 2 455 297 | A1 | 5/2012 |
| GB | 841142 | A | 7/1960 |
| WO | WO 2006/100876 | A1 | 9/2006 |

* cited by examiner

CONTAMINATION-FREE, FLEXIBLE CLOSURE SYSTEM FOR USE ON AT LEAST PARTIALLY FLEXIBLE CONTAINERS

FIELD OF THE INVENTION

The present invention involves a closure system having two containers with each container having a closure with two profile strips. The two profile strips of each container can engage to seal the container closed when separated from the other container. The respective profile strips of the separate containers can engage to connect the containers and their openings to allow contents of the containers to be transferred from one container to the other container in a sealed manner.

BACKGROUND OF THE INVENTION

Especially in the pharmaceutical/biopharmaceutical industry, but also in the chemical and food industry, demands are increasing on the safe handling of powdered materials that are used and to be produced. On the one hand, employees are to be protected as much as possible from any influence by the product. On the other hand, the product is to be protected from any influence by the employee.

Split valves, as for example found in EP 1 083 137 A1, are increasingly being used with great success for the critical system part, that is, the docking site of mobile containers made of high-grade steel in the processing units also made of high-grade steel. This technology allows the containers to be docked almost completely contamination-free at the processing unit. Subsequently, the product is safely added, and the container is likewise undocked contamination-free from the processing unit.

However, an increasing need for the use of disposable containers is presently discernible. The reason for this need is the industrial approach of using these systems to produce different products for cost reasons, and not just to produce a single product. In this context, the issue of cross-contamination increasingly arises. Despite thoroughly cleaning of the containers and the system, remaining traces of the previously produced product can contaminate the new products to be produced. Such cross-contamination can result in an entire production batch being useless and having to be destroyed, which can quickly reach a value of several hundred thousand euros.

By using disposable containers and optimally disposable liners as well in the processing units, this potential problem of cross-contamination can be entirely circumvented.

Furthermore, the use of such disposable components can improve the life cycle assessment of the system operator.

In the conventional cleaning of the systems, the cleaning media used must be completely discarded, for example by burning. The energy expended for cleaning and drying is enormous.

By omitting such cleaning when using disposable containers, the issue of cleaning is almost completely eliminated.

Disposable components must also be eliminated of by burning. However, this burning can be done expending significantly less energy given the considerably smaller volume. Furthermore, by using easily disposable materials such as PE, environmental considerations are again taken into account.

Flexible disposable components are, however, also subject to the same requirements that stainless steel components were previously. In this case as well, the docking, filling and undocking process must be designed to be contamination-free.

The subsequent response to this challenge can be found in disposable closure systems available on the market, such as in EP 1 441 953 81. The greatest flexibility in regard to possible uses with a simultaneously high cost/benefit ratio is arguably offered by profiled closure systems such as found in DE 10200400351 1 84, DE 10 2009 018 565 83 or EP 2 455 297 A1.

The systems having a divided slider that simultaneously opens the docked profiled closures, while docking had proven to be technically infeasible.

The disadvantage of the system with separate sliders that offers the best economical solution at present is that the complementary closures docked by the sliders are initially closed and must be opened in an additional manual step.

However, this additional step poses a large functional risk in practice since the closures can be entirely torn part if not correctly handled, which risk constitutes an unacceptable weak point in view of the intended use.

Furthermore, the profiled closures, which can be docked together by the sliders, have a hooked profile that extends into the product area when in a docked and open state, that is, in the state of product transfer, which is associated with two significant disadvantages.

On the one hand, finely powdered material can easily enter the hooked profile grooves and entirely compromise subsequent functioning.

On the other hand with this design, the material of the profile per se comes into contact with the product since the tubular film of the container can only be attached below the hooking profile, which requires an additional validation, that is, of the profile material, when used in the pharmaceutical industry.

SUMMARY OF THE INVENTION

The underlying problem of the invention is hence to provide an improved profiled closure system with separate sliders that do not have the above disadvantages.

This problem is basically solved according to the invention by a closure with two profiled strips.

Other objects, advantages and salient features of the present invention will become apparent from the following detailed description, which, taken in conjunction with the drawings, discloses a preferred embodiment of the present invention.

BRIEF DESCRIPTION OF THE DRAWINGS

Referring to the drawings that form a part of this disclosure.

DETAILED DESCRIPTION OF THE INVENTION

Figure 1:
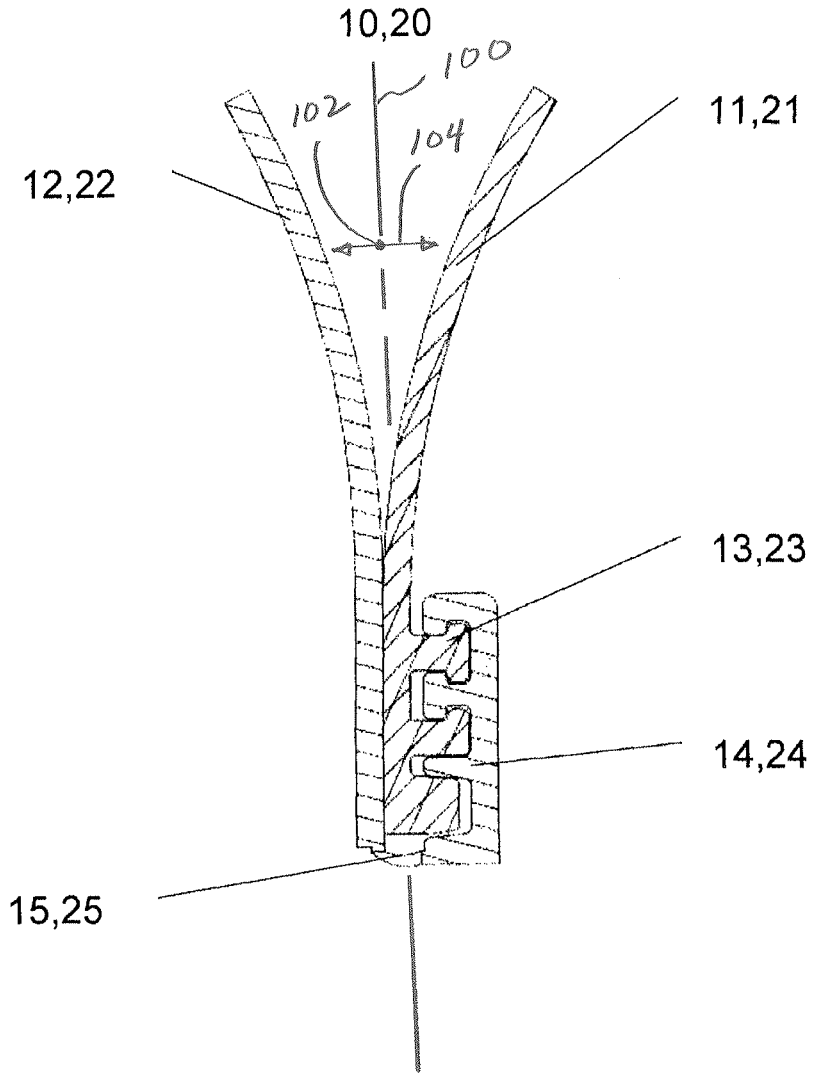
FIG. 1 is a partial side view in section of a container with a closed closure that is closed and not docked, according to an exemplary embodiment of the invention.

A first container 1 can be connected to a second container 2 in an environmentally sealed manner for conducting a flow in a flow direction through the closure 10 from the first container 1 into the second container 2 in an environmentally sealed manner in an open docking or docked position.

The second container 2 has an identical closure that faces the first container 1 and that can be brought into engagement with the first closure 10 of the first container 1 to achieve the open docking position. In the open docking position, the connected closures of the containers define a first flow channel 3 for the bulk goods to flow in the direction of flow D.

Each closure 10 has two profiled strips for closing the at least partially flexible container, one wide profiled strip 12, 22 and one narrow profiled strip 11, 21.

The wide profiled strip extends in the direction of flow beyond the respective container with the first profiled strip 2 arranged parallel to one another. The closure elements of the narrow profiled strips 11, 21 point out of the channel. The closure elements of the wide profile strips 12, 22 point into the channel at the region extending beyond the narrow profiled strip.

This closure element of the wide profiled strip 12, 22 extending beyond the narrow profiled strip is folded 180° over the narrow profiled strip by a hinge 15, 25, such that the two closure elements of the first and second profiled strips engage with each other, and hence, form a closed closure.

To connect and disconnect two complementary closures, a slide, which can be removed from the closures is provided. The slide can be shoved transverse to the direction of flow onto the closed closures for a connection.

The slide 30 has an insertion side and an exit side that oppose each other and are aligned in the direction of flow. At the insertion side, the closures of two containers can be inserted in the direction of insertion. The insertion devices extend transverse to the direction of flow and intersect at an acute angle. The closures can be inserted into the slide aligned relative to each other at that angle.

The closure elements of the two complementary closures are initially open in the slide. The closure element of the wide profiled strip, which is folded over the narrow profiled strip, is positioned over 180°. Guide elements in the slide keep the closures closed.

In this state, the two complementary closures are docked on each other such that the closure element of the wide profiled strip of the first closure is engaged with the closure element of the narrow profiled strip of the second closure and vice versa.

At the exit side, the closures connected to each other by slides can be removed from the slide in a common sliding direction. The respective closure, considered individually, is already open.

To the inside of the channel, there is no longer a hooked profile which could become clogged with finely-powered materials during the product transfer.

When the tubular films of the container are advantageously attached to the inside of the closures, a docking of the tubular film of the first container with the tubular film of the second container can be established, which, in regard to validation, has the significant advantage that the profiled material per se does not have to be validated.

If the closures are separated from each other after the product is transferred, the closure elements of the wide profiled strips folded over the narrow profiled strips then possess the function of a protective strip in addition to the sealing function that additionally shields the closure elements, which are already protected from contacting the product, from potentially contacting the surroundings.

Figure 2:
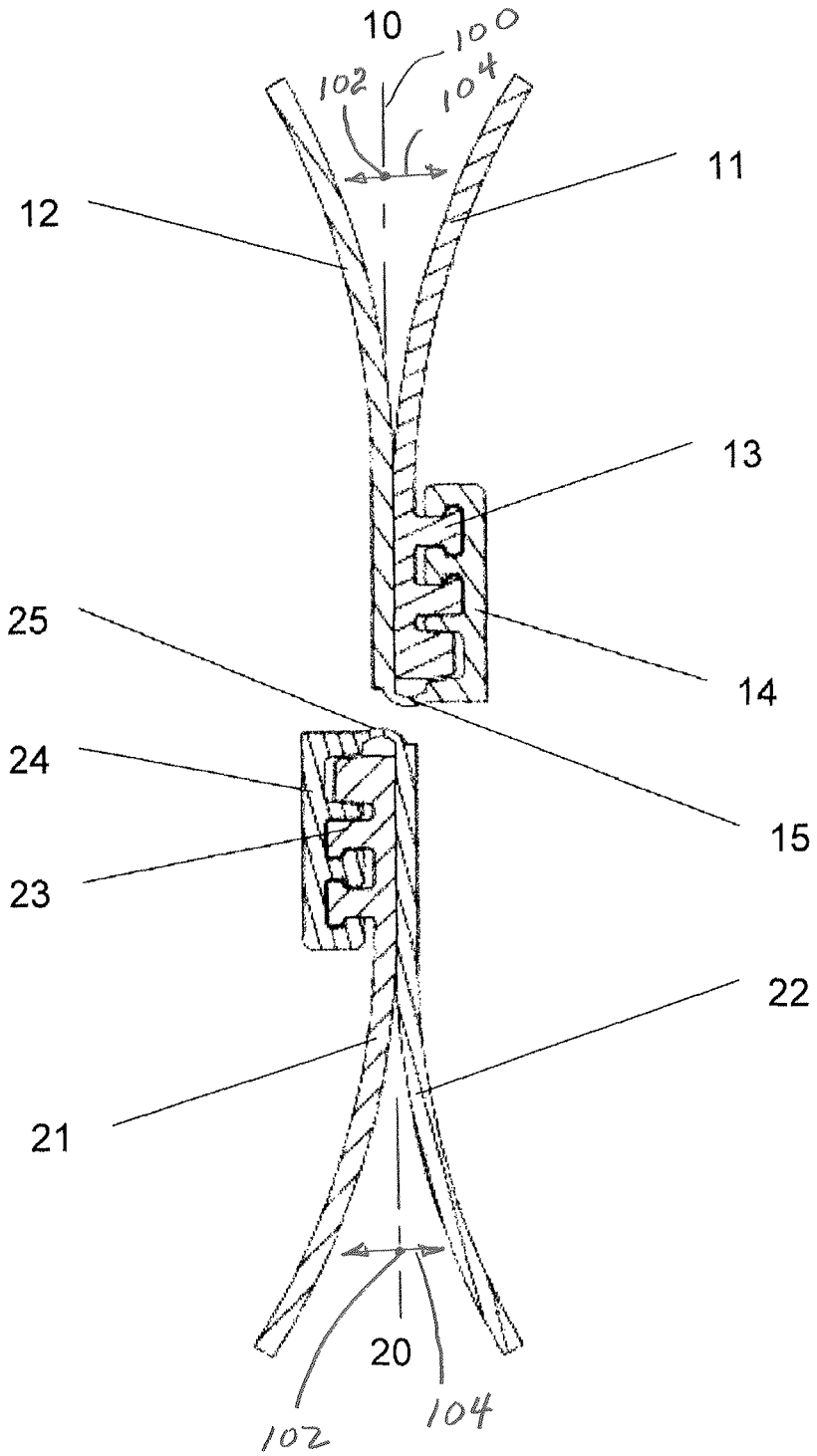
FIG. 2 is a partial side view in section of non-docked, closed closures of two of the containers of FIG. 1 in a docking position, briefly before being inserted into the slider.
Figure 3:
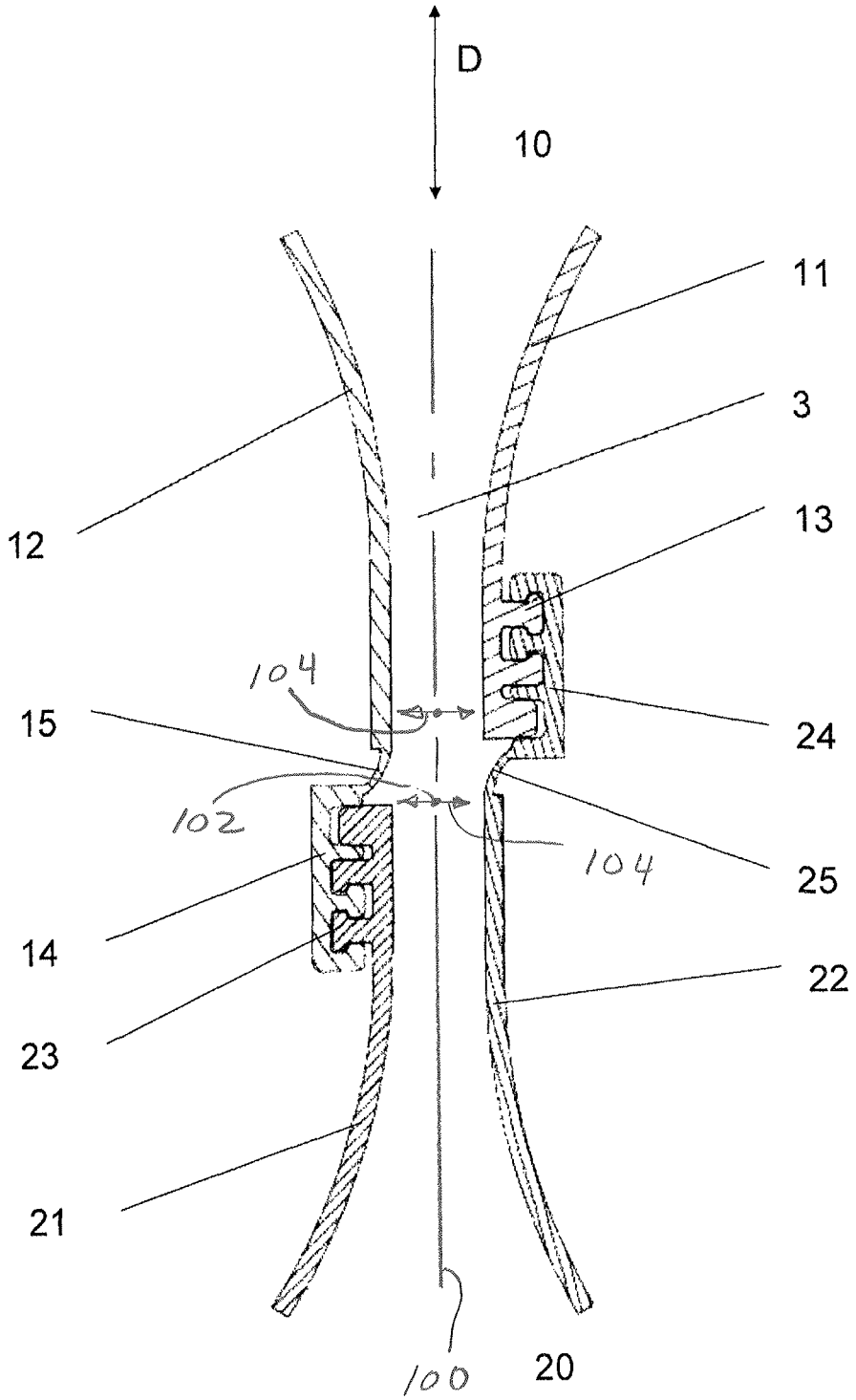
FIG. 3 is a side view in section of the two containers of FIG. 2 with the docked and opened closures (10, 20), after leaving the exit side of the slider.
Figure 4:
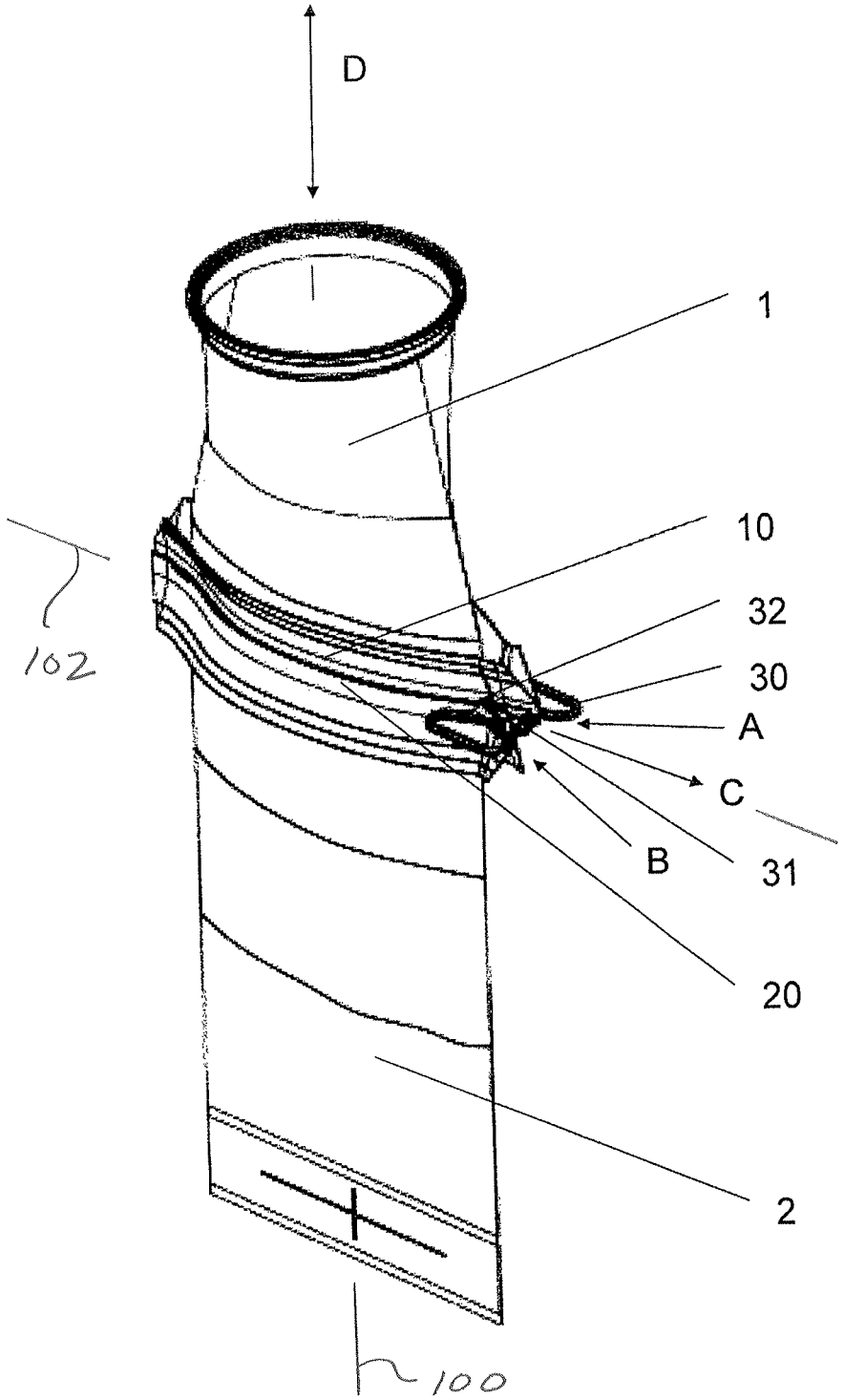
FIG. 4 is a perspective view of two completely docked and opened containers (1, 2) with slide being used.

The container closure system comprises first and second containers 1, 2 being at least partially flexible, extending along container longitudinal axes 100 and being connectable to one another for conducting contents between the first container and the second container in the flow direction D. First and second openings are in the first and second containers, respectively, and extend along opening longitudinal axes 102, with the opening longitudinal axes 102 being perpendicular to the container longitudinal axes 100 and extend perpendicular to the planes of FIGS. 1-3. First and second identical closures 10, 20 extend along the opening longitudinal axes 102 of the first and second openings, respectively. Each of the first and second closures 10, 12 has first and second profile strips 14, 13 and 24, 23 on opposite sides of the respective opening. The first and second profile strips of each of the closures are detachably connectable to each other to separately seal the respective openings of the first and second containers in an undock state of the containers and have closure elements projecting transverse or laterally to the respective container longitudinal axis 100, transverse to the respective opening longitudinal axis 102 and in lateral directions 104 of the openings and the container longitudinal axis 100. The first profile strip 12 of the first closure 10 is detachably connectable to the second profile strip 23 of the second closure 20 and the second profile strip 13 of the first closure 10 is detachably connectable to the first profile strip 24 of the second closure 20 so as to connect interiors of the first and second containers in an environmentally sealed manner in a docked state thereof allowing flow of the contents between the first and second containers through a flow channel 3 defined by the first and second openings. Each of the first profile strips 14, 24 of the first and second closures 10, 20 being pivotally connected to the respective container 10, 20 and points into the respective opening. Each of the second profile strips 13, 23 of the first and second closures 10, 20 points out of the respective opening.

The two containers 1, 2 can each be separately sealed when they are separated or undock. Additionally, the two containers 1, 2 can be connected in a sealed manner with their openings connected to provide a flow channel 3 for contents to flow between the two containers 1, 2 in an environmentally sealed manner and in a manner in which the profile strips are closed and covered. The contents cannot then be trapped within the profile strips 13-14, 23-24 during the transfer of the contents between the containers 1,2. These advantages are provided by the opposite orientations of the profile strips 13-14, 23-24 on each of the containers 1, 2 and the pivotable arrangement of the first profile strips 14, 24 on each container 1, 2.

Each of the profile strips 13-14, 23-24 is aligned exclusively transverse to the flow direction and has only one closure element. The second profile strip 13, 23 of each closure 10, 20 has a closure element pointing out of the respective container opening. The first profile strip 14, 24 of each closure 10, 20 has a closure element pointing into the respective container opening. The first profile strips 14, 24 extend for a longer distance than the second profile strips 13, 23.

The respective closure elements of the first and second profile strips of each container releasably engage and seal the respective closure. The closure elements comprise proportions of a touch-and-close fastener. Each of first profile strips 14, 24 is pivotally connected to the respective container by a film hinge 15. Each container only has the first and second profile strips thereof and does not have other profile strips. Each of first profile strips 14, 24 extends from a first side 12 of the respective container outside of the respective container in a direction perpendicular to the respective opening. Each second profile strip is on an outside surface of a second side 11 of the respective container. Each first side 12 is opposite the respective second side 12. Each of first profile strips 14, 24 is pivotally connected to the respective container by a film hinge 15.

LIST OF REFERENCE SIGNS

1 First container
2 Second container
3 Flow channel
10 First closure
11 Second side of first container
12 First side of first container
13 Second profile strip with element pointing out of the channel of first container
14 First profile strip with element pointing into the channel of first container
15 First film hinge
20 Second closure
21 Second part of second container
22 First part of second container
23 Second profile strip with element pointing out of the channel of second container
24 First profile strip with element pointing into the channel of second container
25 Second film hinge
30 Slide
31 Insertion side
32 Exit side
A Insertion direction
B Continued insertion direction
C Sliding direction
D Direction of flow While one embodiment has been chosen to illustrate the invention, it will be understood by those skilled in the art that various changes and modifications can be made therein without departing from the scope of the invention as defined in the claims.

The invention claimed is:

1. A container closure system, comprising:

first and second containers being at least partially flexible and being connectable to one another for conducting contents between said first container and said second container, in a flow direction, said first and second containers having first and second container longitudinal axes, respectively;

first and second openings in said first and second containers, respectively, said first and second openings having first and second opening longitudinal axes, respectively, extending perpendicularly to said first and second container longitudinal axes, respectively; and first and second identical closures extending along said first and second opening longitudinal axes of said first and second openings, respectively, each of said first and second closures having first and second profile strips on opposite sides of the respective opening, each of said first and second profile strips having a closure element projecting transverse to said container longitudinal axis of the respective container and laterally relative to said container longitudinal axis and relative to the respective opening, said first and second profile strips of each of said closures being detachably connectable to each other to separately seal the respective openings of said first and second containers in an undocked state of said containers, said first profile strip of said first closure being detachably connectable to said second profile strip of said second closure and said second profile strip of said first closure being detachably connectable to said first profile strip of said second closure so as to connect interiors of said first and second containers in an environmentally sealed manner in a docked state thereof allowing flow of the contents between said first and second containers through a flow channel defined by said first and second openings, each of said first profile strips of said first and second closures being pivotally connected to the respective container and pointing into the respective opening, each of said second profile strips of said first and second closures pointing out of the respective openings, each of said containers only having said first and second profile strips thereof and not other profile strips.

2. A container closure system according to claim 1 wherein each of said profile strips is aligned exclusively transverse to the flow direction.

3. A container closure system according to claim 2 wherein said second profile strip of each of said closures has said closure element thereof pointing out of the respective opening;

said first profile strip of each of said closures has said closure element thereof pointing into the respective opening, said first profile strips extend for a longer distance than said second profile strips along the respective opening.

4. A container closure system according to claim 3 wherein the respective closure elements of the first and second profile strips of each of said containers releasably engage and seal the respective closure.

5. A container closure system according to claim 3 wherein said closure elements comprise portions of a touch-and-close fastener.

6. A container closure system according to claim 1 wherein each of said profile strips have only one closure element.

7. A container closure system according to claim 1 wherein each of said first profile strips is pivotally connected to the respective container by a film hinge.

8. A container closure system according to claim 1 wherein each of said first profile strips extends laterally from a first side of the respective container outside of the respective container; and each of said second profile strips extends laterally on an outside surface of a second side of the respective container, each of said first sides being opposite the respective second side.

9. A container closure system according to claim 8 wherein each of said first profile strips is pivotally connected to the respective container by a film hinge.

10. A container closure system comprising:

first and second containers being at least partially flexible and being connectable to one another for conducting contents between said first container and said second container, in a flow direction, said first and second containers having first and second container longitudinal axes, respectively;

first and second openings in said first and second containers, respectively, said first and second openings having first and second opening longitudinal axes, respectively, extending perpendicularly to said first and second container longitudinal axes, respectively; and first and second identical closures extending along said first and second opening longitudinal axes of said first and second openings, respectively, each of said first and second closures having first and second profile strips on opposite sides of the respective opening, each of said first and second profile strips having a closure element projecting transverse to said container longitudinal axis of the respective container and laterally relative to said container longitudinal axis and relative to the respective opening, said first and second profile strips of each of said closures being detachably connectable to each other to separately seal the respective openings of said first and second containers in an undocked state of said containers, said first profile strip of said first closure being detachably connectable to said second profile strip of said second closure and said second profile strip of said first closure being detachably connectable to said first profile strip of said second closure so as to connect interiors of said first and second containers in an environmentally sealed manner in a docked state thereof allowing flow of the contents between said first and second containers through a flow channel defined by said first and second openings, each of said first profile strips of said first and second closures being pivotally connected to the respective container and pointing into the respective opening, each of said second profile strips of said first and second closures pointing out of the respective openings, each of said first profile strips extending laterally from a first side of the respective container outside of the respective container, each of said second profile strips extending laterally on an outside surface of a second side of the respective container, each of said first sides being opposite the respective second side, sides of said container opposite said first and second profile strips being smooth and free of profile strips.

11. A closure system according to claim 10 wherein each of said containers only has said first and second profile strips thereof and not other profile strips.

12. A container closure system, comprising:

first and second containers being at least partially flexible and being connectable to one another for conducting contents between said first container and said second container, in a flow direction;

first and second openings in said first and second containers, respectively; and first and second identical closures extending along said first and second openings, respectively, each of said first and second closures having first and second profile strips on opposite sides of the respective opening, said first and second profile strips of each of said closures being detachably connectable to each other to separately seal the respective openings of said first and second containers in an undocked state of said containers, said first profile strip of said first closure being detachably connectable to said second profile strip of said second closure and said second profile strip of said first closure being detachably connectable to said first profile strip of said second closure so as to connect interiors of said first and second containers in an environmentally sealed manner in a docked state thereof allowing flow of the contents between said first and second containers through a flow channel defined by said first and second openings, each of said first profile strips of said first and second closures being pivotally connected to the respective container and pointing into the respective opening, each of said second profile strips of said first and second closures pointing out of the respective openings, each of said containers only having said first and second profile strips thereof and not other profile strips.

13. A closure system according to claim 12 wherein each of said first profile strips extends laterally from a first side of the respective container outside of the respective container; and each of said second profile strips extends laterally on an outside surface of a second side of the respective container, each of said first sides being opposite the respective second side.

14. A closure system according to claim 13 wherein sides of said container opposite said first and second profile strips are smooth and free of profile strips.

* * * * *